United States Patent [19]

Saegusa

[11] Patent Number: 4,673,342

[45] **Date of Patent: * Jun. 16, 1987**

[54] ROTARY PUMP DEVICE HAVING AN INNER ROTOR WITH AN EPITROCHOIDAL ENVELOPE TOOTH PROFILE

[75] Inventor: Yasuyoshi Saegusa, Itami, Japan

[73] Assignee: Sumitomo Electric Industries, Ltd., Osaka, Japan

[ * ] Notice: The portion of the term of this patent subsequent to Apr. 14, 2004 has been disclaimed.

[21] Appl. No.: 760,822

[22] Filed: May 8, 1985

Related U.S. Application Data

[63] Continuation-in-part of Ser. No. 545,193, Oct. 25, 1983.

[30] Foreign Application Priority Data

Oct. 27, 1982 [JP] Japan ..... 57-189880

[51] Int. Cl.[4] ..... F04C 2/10; F16H 55/08

[52] U.S. Cl. ..... 418/150; 418/166; 418/171; 74/462; 74/804

[58] Field of Search ..... 418/150, 166, 171; 74/462, 804

[56] References Cited

U.S. PATENT DOCUMENTS 2,965,039 12/1960 Morita ..... 418/150

4,504,202 3/1985 Saegusa ..... 418/150

4,518,332 5/1985 Saegusa ..... 418/150

FOREIGN PATENT DOCUMENTS 59-173583 10/1984 Japan ..... 418/150

*Primary Examiner*—John J. Vrablik

*Attorney, Agent, or Firm*—Wenderoth, Lind & Ponack

[57] ABSTRACT

A rotary pump device and an inner gear rotor therefore in which the inner gear rotor has a outer peripheral profile surface whose cross section perpendicular to its central axis is in the form of an inner envelope curve derived by moving a locus circle on an epitrochoidal curve. If the epitrochoidal curve is defined by a base circle of diameter A, a rolling circle of diameter B and an eccentricity of length e, and the locus circle has a diameter C, the inner rotor therefor having an eccentricity ratio $f_e=e/B$, a locus circle ratio $f_c=C/B$ and a base circle ratio $n=A/B$, the ratios $f_e$, $f_c$ and n are selected so as to make the inner envelope curve smooth without any edge portions by selecting the ratios to have values such that $f_c/K_i \leqq 1.1$, wherein $K_i=(n+1)\times|1-2f_e|$. The inner gear rotor is rotatable in an outer gear rotor having circularly arched radially inwardly extending teeth.

9 Claims, 22 Drawing Figures

ROTARY PUMP DEVICE HAVING AN INNER ROTOR WITH AN EPITROCHOIDAL ENVELOPE TOOTH PROFILE

REFERENCE TO RELATED APPLICATIONS

This is a continuation-in-part of applicant's co-pending application Ser. No. 545,193, filed Oct. 25, 1983.

BACKGROUND OF THE INVENTION

This invention relates to a rotary device such as a rotary gear pump in which the inner rotor has an outer tooth profile in the shape of the inner envelope of an epitrochoidal curve.

In a known rotary pump, the outer rotor has a tooth profile whose cross section is defined by a plurality of circular arcs of same radius of curvature centered at equal intervals on a circle of larger diameter defining the respective outer rotor teeth, the circular arcs being located inside the larger circle, and the adjacent circular arcs being connected by radially outwardly curved arcs inside the larger circle.

The inner rotor of this known rotary device has an outer profile in the shape of an inner envelope of an epitrochoidal curve. In an effort to obtain maximum discharge from within the limited volume available between the inner and outer rotors while minimizing pulsation of the discharge and/or reducing cavitation under high speed rotation, prior pumps of this type have been designed with a balancing of maximization of the number of teeth and minimizing the space taken up by the teeth so as to leave as much space as possible for the discharge. This has resulted in a tooth profile defining narrow and/or more sharply angled teeth.

The inventor has found that the parameters selected for the design of the inner rotor in order to meet these criteria have resulted in profiles having edges (discontinuities in slope) which, during use of the rotor in the pump, result in a bearing stress (Hertz stress) at the edge portion which increases to promote wear or settling thereat, thereby resulting in eventual deterioration in pump performance causing vibrations and/or noises. If, as sometimes occurs when the rotor designer becomes aware of the edge portion during the design stage, the edge portion is "smoothed over" during the design stage, and the resulting rotor will not operate at its maximum efficiency, but rather, will operate from the start as if the edge portion had become worn during use.

The present invention has been designed to overcome this problem, to provide a rotary device of the type described above in which the outer rotor is of the type described above with inwardly extending circularly arched teeth and the inner rotor is formed with an outer profile which is an inner envelope of the epitrochoidal curve, but without any edge portions.

SUMMARY OF THE INVENTION

The inventor has found that the edge portions of the inner rotor based on the inner envelope of an epitrochoidal curve are eliminated if parameters of the locus circle in the epitrochoidal curve are appropriately selected. In particular, if the locus circle has a diameter C, and the eiptrochoidal curve is defined by a base circle of diameter A, a rolling circle of diameter B, and an eccentricity of length e, so that the eccentricity ratio $f_e=e/B$, the locus circle ratio $f_c=C/B$ and the base circle ratio $n=A/B$ are defined, then the inner envelope curve will be smooth without any edge portions if $f_c/K_i \leqq 1.0$, wherein $K_i=(n+1)\times|1-2f_e|$. When such an inner gear rotor is mounted for eccentric rotation in an outer rotor having circularly arched radially inwardly extending teeth which mesh with the teeth of the inner rotor, efficient operation of the resultant rotary pump device is obtained. In the preferred embodiment, circular arcs of the outer rotor have radii of curvature approximately equal to C/2 centered with equal spacing on an outer circle of diameter $d_0 \cong A+B$, whereby during rotation of the inner rotor in the outer rotor a small gap between continuously changing ones of the inner teeth and the outer teeth is maintained.

BRIEF DESCRIPTION OF THE DRAWINGS

These and other aspects and features of the invention will be better understood from the following detailed description of the preferred embodiments when taken with the accompanying drawings in which.

DETAILED DESCRIPTION OF THE PREFERRED EMBODIMENTS

Figure 1:
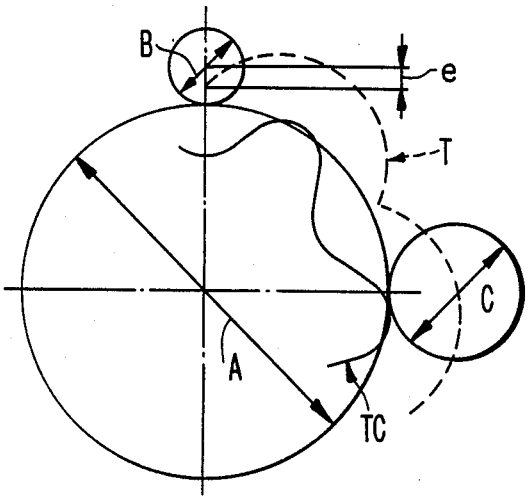
FIG. 1 is an explanatory view of the formation of an inner envelope of an epitrochoidal curve for use in designing an inner rotor.
Figure 6:
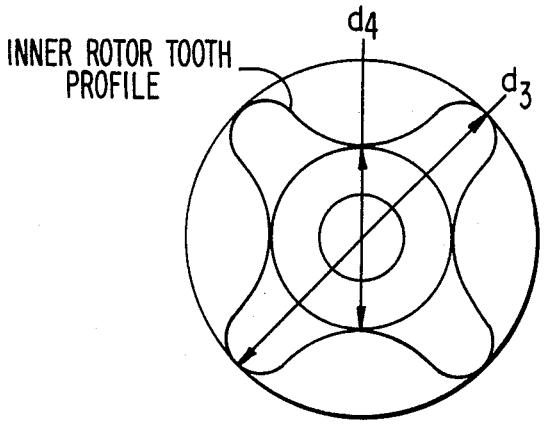
FIG. 6 is an explanatory view of an epitrochoidal envelope for an inner rotor in accordance with the present invention.
Figure 10:
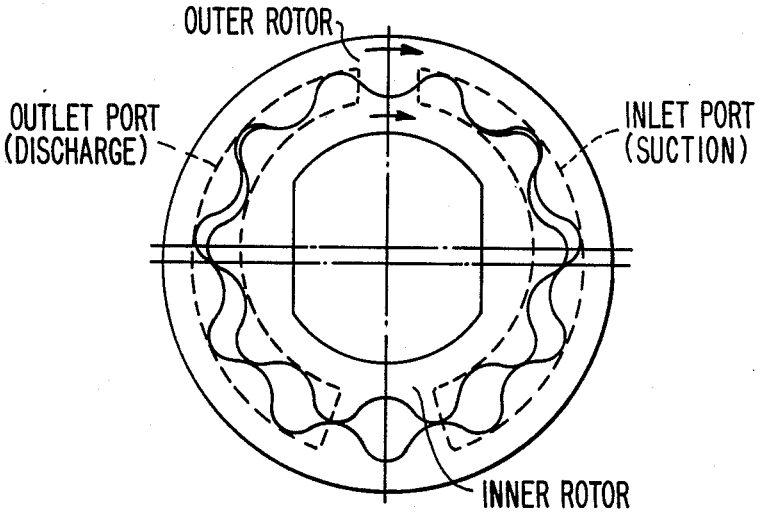
FIG. 10 is an explanatory drawing of an inner rotor assembled in an outer rotor.

In a rotary pump of this invention having inner and outer rotors and inlet and outlet ports as illustrated in FIG. 10 in which the inner and outer surfaces of the inner and outer gear rotors are defined utilizing the epitrochoidal curve, the periphery of the inner rotor is defined as is illustrated in FIG. 1 by first generating an epitrochoidal curve T as a locus of a fixed point inside the rolling circle of diameter B distanced from its center by an eccentricity e when the rolling circle is rolled on a base circle of diameter A without any slip. The outer periphery of the inner rotor (the inner rotor gear tooth shape or profile) TC can be formed in accordance with the prior art as the locus of points defined by a point on a circle of diameter C nearest the center of the base circle of diameter A as the center of the locus circle moves along the epitrochoidal curve T. The inner rotor will have a number of teeth $n_i$ equal to $n=A/B$. Referring to FIG. 6, it is well known that such a rotor will have a major diameter $d_3$ defined by:

$$d_3 = A + B - C + 2e.$$
$$= (n + 1)B - C + 2e.$$

Similarly, the minor diameter $d_4$ of the inner rotor is defined by:

$$d_4 = A + B - C - 2e.$$
$$= (n + 1)B - C - 2e.$$

Thus, it is clear that such an inner rotor tooth profile is determined by four parameters, either (A, B, C, e) or (n, B, C, e) or (n, A, C, e).

Figure 7:
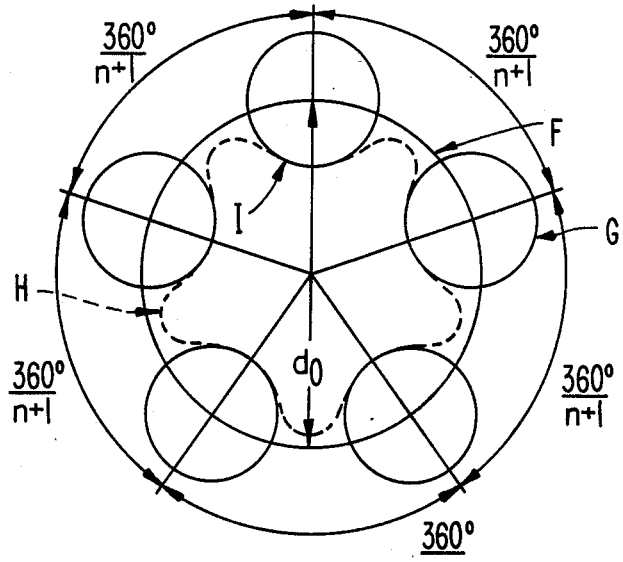
FIG. 7 is an explanatory drawing of a curve utilized in forming an outer rotor in accordance with the present invention.
Figure 8:
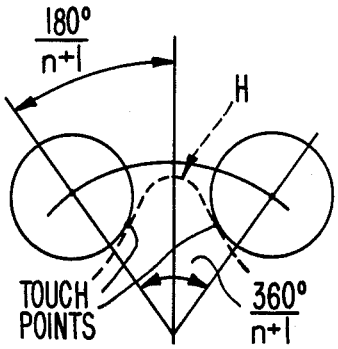
FIG. 8 is an explanatory drawing of part of FIG. 7.

A known, theoretical outer rotor for use with the above-described inner rotor is formed utilizing the same parameters as were used for the inner rotor. Referring to FIGS. 7 and 8, the outer rotor tooth profile is formed of two portions including the dashed portions H and the solid line portions I (the inner portions of the circles G). The dashed portions H have the same profile as the tooth portions of the inner outer profile described above. The circles G are equiangularly spaced on a circle F of diameter $d_0$ where $$d_0=A+B=(n+1)B$$

The circles G have a diameter C (the same as the diameter of the locus circles described above). The number of circles G is equal to $n+1$.

Figure 9:
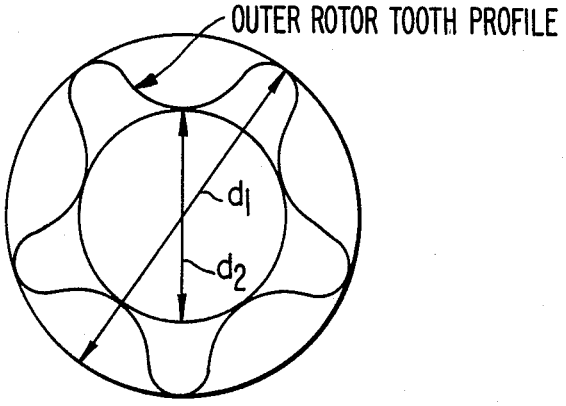
FIG. 9 is an explanatory drawing showing the major and minor diameters of the drawing shown in FIG. 8.

Referring to FIG. 9, illustrating the outer rotor tooth profile, the outer rotor tooth profile has a major diameter $d_1$ given by:

$$d_1 = A + B - C + 4e$$
$$= (n + 1)B - C + 4e.$$

Similarly, the minor diameter $d_2$ of the outer rotor to the profile is given by:

$$d_2 = A + B - C$$
$$= (n + 1)B - C.$$

Thus, the profile of the outer rotor tooth profile is also given by four parameters, that is, (A, B, C, e) or (n, B, C, e) or (n, A, C, e).

An inner rotor of the type described mounted on an outer rotor of the type described in schematically illustrated in FIG. 10.

Figure 11:
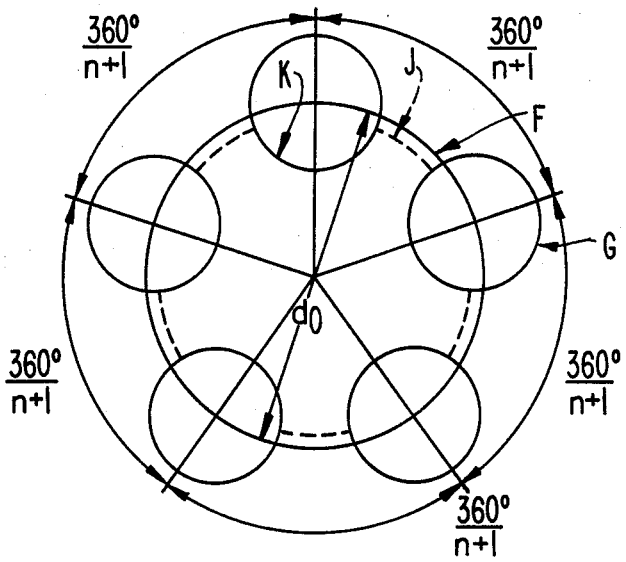
FIGS. 11 and 12A are drawings similar to FIGS. 7 and 8, respectively, for an outer rotor in accordance with a second embodiment of the invention.
Figure 12A:
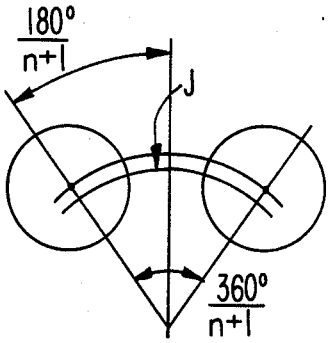
Figure 12B:
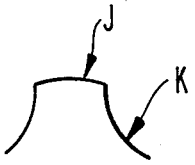
FIG. 12B is an explanatory drawing showing a portion of FIG. 12A.

The inner tooth profile of another outer rotor which may be utilized in accordance with the present invention is illustrated in FIGS. 11, 12A and 12B. This embodiment differs from the above-described embodiment only in that the portions J of the profile between the circularly arched portions K (of diameter C) are primarily portions of a circle of diameter less than $d_0$, and thus such profile is a function of $d_0$ and C, or three parameters, that is, (A, B, C) or (n, B, C) or (n, A, C) since $d_o=A+B$ and $n=A/B$ as indicated above. The portions J may be rounded slightly at their intersections with portions K.

Figure 13:
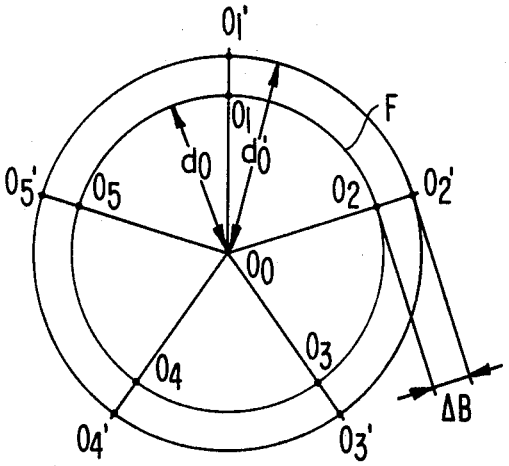
FIGS. 13 and 14 are explanatory drawings showing a modification of the embodiment of the outer rotor illustrated in FIG. 11.
Figure 14:
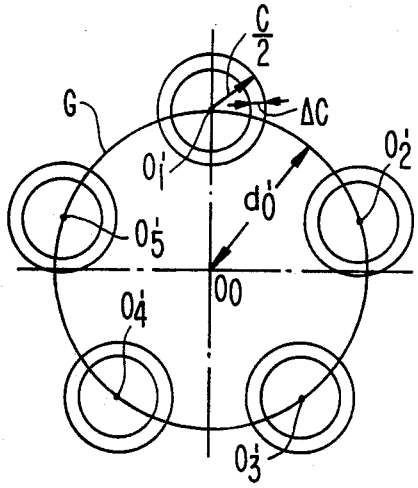

In an actual prior rotary device utilizing the above-described inner rotor and second above-described embodiment of the outer rotor, the dimensions of the outer rotor teeth are reduced somewhat in order to provide a clearance known as a combinational gap, between an inner tooth and an adjacent outer tooth as the inner rotor rotates, so as to permit smoother rotation of the inner rotor. An improvement to this arrangement is described in applicant's co-pending application Ser. No. 448,503, now U.S. Pat. No. 4,504,202. Referring to FIGS. 13 and 14 illustrating this improvement, by increasing the radius $d_0/2$ of the circle F by an amount $\Delta B$ and increasing the radius $C/2$ of the circles G by an amount $\Delta C$, smooth rotation of the inner rotor will be retained while creating almost constant clearance between the inner and outer rotors provided that $\Delta B$ and $\Delta C$ satisfy the following in equalities:

$$|\Delta B| + |\Delta C| < .3 \text{ mm},$$
$$\Delta B > \Delta C.$$

The improvement is equally applicable to the above-described first embodiment of the outer rotor. This outer rotor design can be utilized in accordance with the rotary device of the present invention.

As is described above, the use of the above-described inner rotor with either of the above described outer rotors permits a generally uniform tip clearance to be obtained. However, if the inner rotor has an edge portion as is generally described above and described in detail below, it will be worn away during use in such a manner that the uniform tip clearance will not be retained, even in the case of the modifications of the outer rotor by $\Delta B$ and $\Delta C$ as described above, thereby promoting wear and deterioration of pump performance. The present invention overcomes this problem by eliminating the edge portion.

Figure 2A:
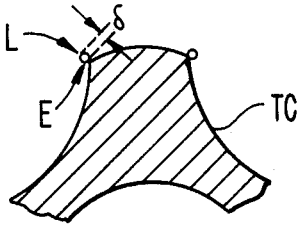
FIG. 2A. (PRIOR ART)
FIG. 2A is a schematic drawing of a portion of an epitrochoidal envelope formed in accordance with the prior art with a duplication portion.
Figure 2B:
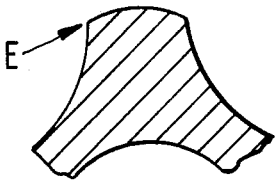
FIG. 2B. (PRIOR ART)
FIG. 2B is a schematic drawing of a portion of an epitrochoidal envelope having an edge portion without a duplication portion.
Figure 2C:
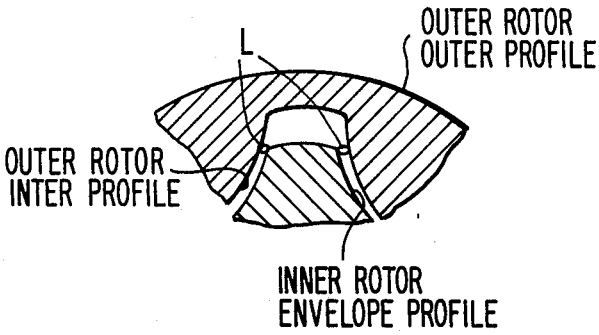
FIG. 2C. (PRIOR ART)
FIG. 2C is an explanatory partial cross-sectional view of an inner rotor formed with the curve shown in FIG. 2A in relation to an outer rotor.
Figure 3A:
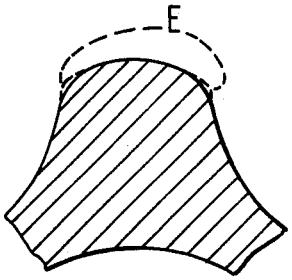
FIG. 3A. (PRIOR ART)
FIG. 3A is a partial cross-sectional view of a prior art rotor in which the edge portions have been removed or worn down.

Referring to FIG. 2A, when the inner rotor in accordance with the prior art was designed, in forming the inner envelope, an edge portion was defined because small loops were created at particular locations along the envelope TC. Such loops are illustrated in FIG. 2A wherein the loops L are enlarged out of proportion to their normal size so that they can be seen by the naked eye. Loops, hereinafter to be referred to as "duplication portions", which, of course, are not present in the actual inner rotor, appear to be present in the mathematical analysis of the relation between the inner rotor and the outer rotor to obtain a theoretically ideal fit. As illustrated in FIG. 2C, since the actual inner rotor will not include the "duplication portion" and the edge will be removed either during initial manufacture or worn away during use, the tip clearance between the inner rotor and the outer rotor is not ideal, but becomes large and non-uniform, resulting in a reduction in pumping efficiency and an increase in noise. An exaggerated profile of the edge portion E of an actual rotor is illustrated in FIG. 2B and the same rotor either worn or intentionally smooth at the edge portion is illustrated in FIG. 3A. FIG. 2C shows in exaggerated form a gap between an inner rotor tooth and an outer rotor tooth resulting from the "duplication portion" which is shown in dashed line.

Figure 3C:
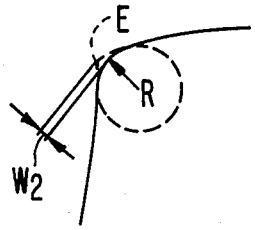
FIG. 3C. (PRIOR ART)
FIG. 3C is a partial view of an epitrochoidal curve of the type illustrated in FIG. 2A, with the duplication portion rounded off.
Figure 3B:
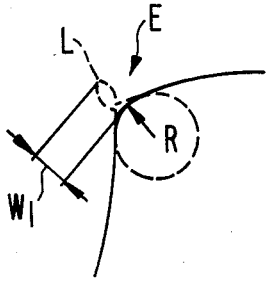
FIG. 3B. (PRIOR ART)
FIG. 3B is a partial view of an epitrochoidal envelope of the type illustrated in FIG. 2B with edge portion rounded off.

As indicated above, the profile illustrated in FIG. 2A does not represent a realizable rotor profile, the actual rotor having a profile without the "duplication portion". In this case, the actual inner rotor used in a rotary device having an outer rotor as described above, will experience bearing stress (Hertz stress) at the edge portion so as to promote wear or settling at the edge with the effects as described above. Therefore, in accordance with the prior art, the edge portion has been initially corrected as illustrated in FIG. 3A by rounding of the edge portions of the envelope and actual tooth profiles respectively illustrated in FIGS. 2A and 2B as shown in FIGS. 3B and 3C in which $W_1$ is the width of the edge including the loop L in FIG. 2A and $W_2$ is the size of the actual edge E in FIG. 2B.

However, such correction will result in a reduction in the size of each tooth profile so that the resulting inner rotor profile differs from the theoretically ideal epitrochoidal envelope curve of the inner rotor, which is quite similar in effect to a rotor which has worn by an amount $W_1$ after use, thus resulting in the same reduction in performance of the rotary pump device as would be produced by wear.

Figure 15:
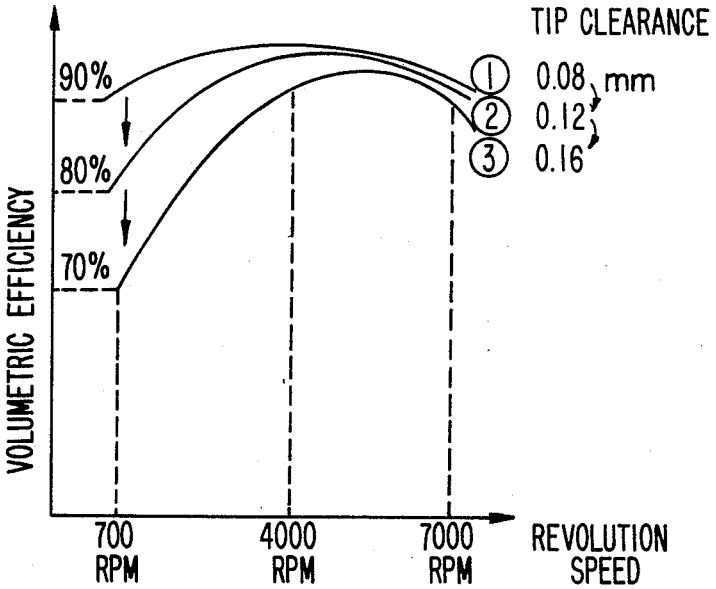
FIG. 15 is a graph showing the relationships between tip clearance, rotor speed and volumetric efficiency.

The decrease in pumping efficiency caused by the increase in tip clearance is particularly striking under such operating condition as low speed of, and high pressure and low viscosity fluid in, the rotary device. For example, for a speed of 700 rpm, a discharge pressure of 5 kg/cm$^2$, a viscosity of 10 cst and a side clearance of 0.05 mm between the pump housing and rotor set. The decreasing volumetric efficiency with increasing tip clearance and decreasing rotor speed is illustrated in FIG. 15. The inventor has observed that even with the improved outer rotor disclosed in the inventor's U.S. Pat. No. 4,504,502 as discussed above, the tip clearance variation during rotation cannot be reduced as much as desired with the prior art inner rotor having an edge portion based on a design with the duplication portion on the epitrochoid envelope profile.

Figure 4A:
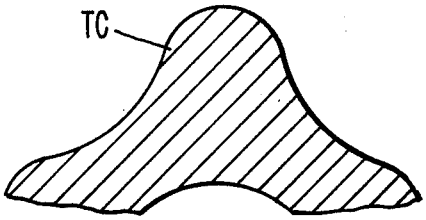
FIG. 4A is a partial cross sectional view of an inner rotor in accordance with the present invention.
Figure 4B:
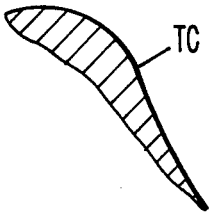
FIG. 4B is an enlarged view of a portion of FIG. 4A.
Figure 5A:
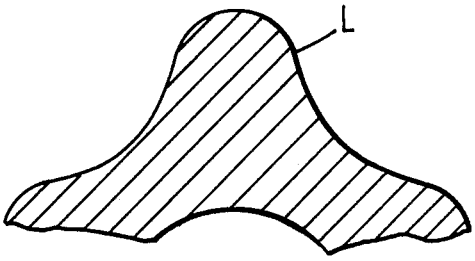
FIG. 5A. (PRIOR ART)
FIG. 5A is a partial cross-sectional view of an inner rotor having a duplication portion.
Figure 5B:
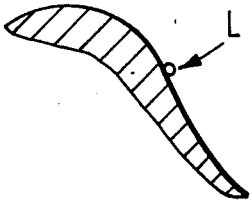
FIG. 5B. (PRIOR ART)
FIG. 5B is an enlarged view of a portion of FIG. 5A.

In order to eliminate the duplication portion from the epitrochoid envelope of the inner rotor design and the edge portion of the actual inner rotor profile which are illustrated in FIGS. 5A and 5B, the inventor determined after detailed study that if the parameters of the inner envelope of the epitrochoidal curve defining the cross section of the inner rotor are represented by a base circle diameter A, a rolling circle diameter B, a locus circle diameter C, an eccentricity e, and eccentricity ratio $f_e=e/B$ and locus circle ratio $f_c=C/B$ and base circle ratio $n=A/B$, then the duplicate portion and edge portion will be eliminated as illustrated in FIGS. 4A and 4B if the following inequality is satisfied:

$$f_c/ki \leqq 1.0, \text{ wherein}$$

$$ki = (n+1) \times |1 - 2f_e|$$

The inventor has also found that the duplication portion can be substantially eliminated if $f_c/K_i$ is in the range 1.0 to 1.1, and the number of teeth $n_i$ on the inner rotor is equal to the closest integer to $d_4/2e$ where $d_4$ is the minor diameter of the inner rotor (see FIG. 6). Also, the inventor has found that irrespective of the number of teeth, the duplication portion will be maintained small within an acceptable range for some applications such as low pressure usage or high viscosity fluid usage, i.e., within the range 0.01–0.02 mm, for $f_c/K_i=1.1$ if the size of the inner rotor is not too large, i.e., an inner rotor corresponding to an outer diameter of the outer rotor no greater than approximately 100 mm.

To illustrate the effect on the duplication portion of proper selection of the ratio $f_c/K_i$, examples of the parameters and the size of the duplication portion of known prior inner rotors are listed in Table 1 below for comparison to the parameters and size of the duplication portion of inner rotors, in accordance with the present invention of substantially the same overall size as the prior rotors, which are listed in Table 2 below. In the Tables, the symbols $\phi$23 and $\phi$40 indicate the outer diameters of the outer rotors of the rotary devices in which the inner rotors are positioned.

TABLE 1

| Dimension Item | $d_4/2e$ | $n_i$ | $f_c/K_i$ | $\delta$ |
|---|---|---|---|---|
| $\phi$23 | 5.976 | 7 | 2.01 | 0.03~0.05 |
| $\phi$40 | 3.345 | 4 | 1.20 | 0.01~0.03 |

TABLE 2

| Dimensions Item | $d_4/2e$ | $n_i$ | $f_c/Ki$ | $\delta$ |
|---|---|---|---|---|
| $\phi$23 | 5.976 | 6 | 1.01 | 0 |
| $\phi$40 | 3.346 | 3 | 0.91 | 0 |

Thus, as is apparent from a comparison of Tables 1 and 2, even for $f_c/K_i=1.01$, the size of the duplication portion is substantially zero.

While particular embodiments of the present invention have been illustrated and described, it will be apparent to those skilled in the art that various changes and modifications can be made without departing from the scope and spirit of the invention which is limited only by the appended claims.

What is claimed is:

1. An inner gear rotor for eccentric rotation in an outer gear rotor of a rotary gear pump, comprising an inner rotor member having a center axis and an outer peripheral profile surface whose cross section perpendicular to said center axis is in the form of an inner envelope curve derived by moving a locus circle of diameter C with its center on an epitrochoidal curve, said epitrochoidal curve having dimensions defined by a base circle of diameter A, a rolling circle of diameter B and an eccentricity of length e, whereby said member has an eccentricity ratio $f_e=e/B$, a locus circle ratio $f_c=C/B$ and a base circle ratio $n=A/B$, said ratios $f_e$, $f_c$ and n defining a quantity $K_i=(n+1)\times|1-2f_e|$; said ratios having values such that $f_c/K_i \leqq 1.1$.

2. A rotor as in claim 1, wherein $f_c/K_i \leqq 1.0$.

3. A rotor as in claim 1, wherein said rotor member has a number of teeth $n_i$ and has a minor diameter $d_4$, such that $n_i$ is equal to the nearest integer to $d_4/2e$.

4. A rotor as in claim 3, wherein $1<f_c/K_i \leqq 1.1$.

5. In a rotary pump device the improvement comprising:

an outer gear rotor having a first center axis and an inner peripheral profile surface whose cross section perpendicular to said first center axis includes a number $n_o$ of circular arcs defining $n_o$ respective outer teeth extending toward said first axis, said arcs having equal radii of curvature r and being centered on an outer circle of diameter $d_o$ surrounding said arcs at equally spaced points along said outer circle; and an inner gear rotor eccentrically rotatable in said outer gear rotor, said inner gear rotor having a number $n_i$ less than $n_o$ of inner teeth in meshing relation to said outer teeth, having a second center axis parallel to said first center axis, and having an outer peripheral profile surface whose cross section perpendicular to said second axis is in the form of an inner envelope curve derived by moving a locus circle of diameter C with its center on an epitrochoidal curve, said epitrochoidal curve having dimensions defined by a base circle of diameter A, a rolling circle of diameter B and an eccentricity of length e, whereby said inner rotor has an eccentricity ratio $f_e=e/B$, a locus circle ratio $f_c=C/B$ and a base circle ratio $n=A/B$, said ratios $f_e$, $f_c$ and n defining a quantity $K_i=(n+1)\times|1-2f_e|$; said ratios having values such that $f_c/K_i \leqq 1.1$; said outer circle having a diameter $d_o \cong A+B$, said radii of curvature r being approximately equal to C/2, such that during rotation of said inner rotor in said outer rotor a small gap is located between continuously changing ones of said inner teeth and said outer teeth.

6. In a rotary pump device as in claim 5, the improvement wherein $f_c/K_i \leqq 1.0$.

7. In a rotary pump device as in claim 5, the improvement wherein the inner rotor has a minor diameter $d_4$, such that $n_i$ is equal to the nearest integer to $d_4/2e$.

8. In a rotary pump device, as in claim 5, wherein $1<f_c/K_i \leqq 1.1$.

9. In a rotary pump device as in claim 5, the improvement wherein $d_o=A+B+2\Delta B$, $r=C/2+\Delta C$, $|\Delta B|+|\Delta C|<0.3$ mm and $\Delta B>\Delta C$.

* * * * *